US007837129B2

(12) United States Patent
Schuerle et al.

(10) Patent No.: US 7,837,129 B2
(45) Date of Patent: Nov. 23, 2010

(54) METERING DEVICE

(75) Inventors: Holger Schuerle, Neuenburg (DE); Joachim Koerner, Uhldingen-Muehlhofen (DE); Michael Helmlinger, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 335 days.

(21) Appl. No.: 12/002,329

(22) Filed: Dec. 14, 2007

(65) Prior Publication Data

US 2009/0236437 A1 Sep. 24, 2009

(30) Foreign Application Priority Data

Dec. 15, 2006 (DE) ..... 10 2006 061 506

(51) Int. Cl.
*B05B 1/08* (2006.01)
*B67D 7/08* (2010.01)
*B05B 15/00* (2006.01)
*B05B 1/00* (2006.01)

(52) U.S. Cl. ..... 239/102.2; 239/73; 239/102.1; 239/288; 239/288.5; 239/596

(58) Field of Classification Search ..... 239/4, 239/67, 69, 71, 73, 102.1, 102.2, 288, 288.3, 239/288.5, 548, 596; 417/322, 413.2, 413.3
See application file for complete search history.

(56) References Cited

U.S. PATENT DOCUMENTS 5,635,337 A 6/1997 Bartha et al.
5,759,015 A * 6/1998 Van Lintel et al. ..... 417/322
6,142,607 A 11/2000 Takata et al.
6,196,219 B1 * 3/2001 Hess et al. ..... 128/200.21
6,405,934 B1 * 6/2002 Hess et al. ..... 239/4
2003/0234298 A1 * 12/2003 Chen ..... 239/102.2
2004/0192044 A1 9/2004 Degertekin et al.

(Continued)

FOREIGN PATENT DOCUMENTS

DE 10 2004 006 452 A1 8/2005

(Continued)

OTHER PUBLICATIONS

Office Action from Germany Patent Office dated Jul. 13, 2007 (3 pages).

(Continued)

*Primary Examiner*—Darren W Gorman
(74) *Attorney, Agent, or Firm*—Flynn, Thiel, Boutell & Tanis, P.C.

(57) ABSTRACT

A metering device for dispensing a medium to an environment is provided. The metering device includes a housing, a shallow metering chamber within the housing which is of planar design and is essentially closed off from the environment by wall sections, a first media inlet which is connected to the metering chamber and can be connected to a media reservoir, and a vibration mechanism which is arranged in such a manner that vibrations generated by the vibration mechanism cause pulsing changes in volume of an internal volume of the metering chamber. A wall section which is designed as an outlet wall section has metering openings so that the metering chamber is connected to the environment. The vibration mechanism forms a vibration wall section so that the metering chamber is delimited.

7 Claims, 4 Drawing Sheets

U.S. PATENT DOCUMENTS

| | | | |
|---|---|---|---|
| 2004/0195394 | A1 | 10/2004 | Cornet et al. |
| 2005/0054208 | A1 | 3/2005 | Fedorov et al. |
| 2005/0139465 | A1 | 6/2005 | Kasuya et al. |
| 2005/0201870 | A1 | 9/2005 | Koerner et al. |
| 2005/0207917 | A1 | 9/2005 | Koerner et al. |
| 2006/0032941 | A1 | 2/2006 | Sheng-Chih et al. |

FOREIGN PATENT DOCUMENTS

| | | | |
|---|---|---|---|
| DE | 10 2004 011 726 | A1 | 9/2005 |
| EP | 0 897 755 | A2 | 2/1999 |
| EP | 1 273 355 | A1 | 1/2003 |
| EP | 1 533 041 | A1 | 5/2005 |
| WO | WO 2005/107946 | A2 | 11/2005 |
| WO | WO 2006066671 | A1 * | 6/2006 |
| WO | WO 2006/112357 | A1 | 10/2006 |

OTHER PUBLICATIONS

European Patent Office Search Report dated Sep. 16, 2008 (5 pages).
European Patent Office Search Report dated Nov. 13, 2008 (17 pages).

* cited by examiner

METERING DEVICE

FIELD OF THE INVENTION

The invention relates to a metering device for dispensing a medium to an environment, with a housing, a shallow metering chamber within the housing, which metering chamber is of planar design and is essentially closed off from the environment by wall sections, a first media inlet which is connected to the metering chamber and can be connected to a media reservoir, and a vibration mechanism which is arranged in such a manner that vibrations generated by it cause pulsing changes in volume of an internal volume of the metering chamber, wherein a wall section which is designed as an outlet wall section has metering openings by means of which the metering chamber is connected to the environment.

BACKGROUND OF THE INVENTION

Metering devices of this type are known, for example, from DE 10 2004 011 726 A1. They permit the dispensing of a medium in a mist-like form. For dispensing purposes, the medium is brought from the media reservoir into the metering chamber and, as a result of the high-frequency changes in volume generated by means of the vibration mechanism, emerges from said metering chamber through the metering openings. This form of media discharge may be advantageous both for pharmaceutical and for cosmetic substances.

Disadvantages of the metering devices known from the prior art include the complex design, the discharge of medium through the metering openings not always being reliable and constant, and the inadvertent escape of medium before the device is put into operation.

SUMMARY OF THE INVENTION

It is the object of the invention to develop metering devices of the type in question in respect of having lower production costs and greater reliability.

This object is achieved by a metering device of the type in question, in which the vibration mechanism forms a vibration wall section by means of which the metering chamber is delimited.

The arrangement of the vibration mechanism in such a manner that it is in direct contact with the medium within the metering chamber and outwardly delimits the metering chamber results in the vibrations being passed to the medium particularly readily and without damping. The expenditure of energy required for discharging media is therefore low. Within the metering chamber, the vibration wall section may be fitted to another wall section and fastened thereto, for example by means of adhesive bonding. However, the vibration wall section is preferably provided at a point of a wall section which is provided integrally with the housing and is inserted at the position of said wall section into an aperture of the housing. The vibration wall section is understood within the meaning of this invention as meaning a wall section which is formed integrally with the vibration mechanism which triggers the vibration. A surface of the vibration mechanism is preferably used directly as the vibration wall section. In the case of a planar piezo actuator or a piezo actuator stack constructed from such piezo actuators, the surface of said piezo actuator or of the uppermost piezo actuator preferably constitutes the vibration wall section. However, configurations are also included, in which another surface section as an integrally formed component of the vibration mechanism together with an actuator, such as a piezo actuator, provided in the vibration mechanism forms the vibration wall section.

In a development of the invention, the vibration wall section closes off the metering chamber on a side which is opposite the outlet wall section.

This arrangement is particularly expedient for an ideal discharge of media. In this case, the vibration mechanism is arranged and designed with respect to the vibration direction in such a manner that the vibrations have a main movement direction which points in the direction of the opposite metering openings. The medium, which is displaced by the vibrations, can therefore emerge from the metering openings of the outlet wall section directly in the displacement direction.

A development is particularly advantageous, in which the housing has an aperture for receiving the vibration wall section and, preferably on a border of the aperture, has an encircling bearing web which extends radially into the aperture.

In such an embodiment, the vibration wall section forms a wall section which is accessible both from the outside and from the metering chamber, which is advantageous with regard to saving material and a simple construction. The effect achieved by accessibility from the outside is that electric lines for supplying power and activating the vibration mechanism do not have to be led out of the metering chamber through cable ducts provided separately for this purpose. Instead, the corresponding lines can be provided on a rear side of the vibration mechanism, which side faces away from the metering chamber, and can be led out through the aperture.

The provision of a bearing web which extends into the aperture makes assembly particularly simple, since a complicated alignment of the vibration wall section is not required. The vibration wall section is pressed against the bearing web and is fastened there. This fastening takes place preferably in an interlocking manner, for example by means of latching grooves, or with a cohesive material joint, for example by means of adhesive or by a welded joint made of plastic.

In a development of the invention, the housing is of multi-part design and has an upper part and a lower part, a receiving space for receiving the vibration wall section being provided in the upper part and/or in the lower part, and the receiving space being delimited by sections on the upper-part side and lower-part side.

In a multi-part housing of this type, the metering chamber is preferably arranged between the fitted-together housing parts. In this case, the receiving space for the vibration wall section, which is directly adjacent to the metering chamber, is arranged in such a manner that fixing sections of the upper part and fixing sections of the lower part are in touching contact with the inserted vibration wall section. In a configuration of this type, joining the two housing parts together leads at the same time to the vibration wall section being fixed. A separate fixing going beyond the fastening means for fastening the two housing parts to each other is not required. In particular, it is advantageous if a cutout is provided in the lower part, into which cutout the vibration wall section is inserted and into which it is pressed, after the upper part is placed on, by means of fixing sections, for example in the form of plastic extensions, on the upper-part side.

The invention relates furthermore to a metering device of the type in question, in which an outer side of the outlet wall section, which is arranged on that side of the outlet wall section which faces away from the metering chamber, is provided with a heating element.

A heating element of this type leads to rapid drying of an undesirable liquid film on the outer side. A liquid film of this type obstructs the discharge of medium in mist form, since the medium discharged through the metering openings accumulates on the liquid film which is already present. The heating mechanism makes it possible to heat the outer side to an extent such that the production of a liquid film is prevented or rapid drying of a liquid film which is already being produced is ensured. An example of a suitable heating element is a heating coil which is arranged on the outer border of the outer side and/or runs transversely over the outer side of the outlet wall section.

In a preferred development, the heating element is of planar design and is preferably designed as a resistance layer applied to the outer side of the outlet wall section.

A resistance layer of this type constitutes a particularly simple form of heating element that, firstly, is advantageous with regard to the outlay on production, since it can be produced by cost-effective vapor deposition, and that, secondly, is expedient with regard to drying of the entire surface. Furthermore, a resistance layer of this type permits a flat design of the outer side without bumps which promote the formation of a liquid film. The resistance layer does not have to cover the entire outer surface. A resistance layer which is provided only in the region of the metering openings may also be expedient.

The invention relates furthermore to a metering device of the type in question, in which a protective cap is provided on a side of the metering openings that faces away from the metering chamber, said protective cap, in a closed state, closing off the metering openings from the environment and, in an open state, opening up the metering openings in relation to the environment.

A protective cap of this type serves, firstly, to protect the outlet wall section against mechanical influences, which is expedient in particular in the case of an outlet wall section made of silicon or another mechanically sensitive material. Furthermore, it also provides protection against microbiological contamination of the metering chamber and of the emerging medium. In addition, such a protective cap also prevents the undesirable emergence of the medium when the metering device is not in use.

In a preferred development, the protective cap has an elastic sealing means, this preferably being a sealing lip which, in the closed state of the protective cap, closes off the metering openings from the environment.

The elastic sealing means opposes microbiological contaminations. The provision of a sealing means of this type makes it possible to reduce the requirements in respect of the dimensional stability of the housing and the protective cap.

In a development of the invention, the protective cap is designed as an actuating means for operating the metering device.

In such an embodiment, the protective cap takes on a dual function of providing protection for the metering device and the medium and, in the open state, of permitting the medium to emerge through actuation. This dual function ensures that actuation of the metering device is possible only after the protective cap has been opened. Protective caps which are designed as hinged closures provided pivotably on the housing are particularly advantageous, since protective caps of this type can be realized in a captive and structurally simple manner.

In a development of the invention, the protective cap is fastened to the housing of the metering device and is movable between the closed state and the open state, with identification means for identifying at least one protective cap position being provided, and with the identification means being operatively connected to the vibration mechanism and/or a conveying mechanism for conveying the medium in such a manner that a movement of the protective cap into this protective cap position activates or deactivates the vibration mechanism and/or the conveying mechanism.

In the case of a metering device of this type, the protective cap is moved during the course of the opening in such a manner that it opens up the metering openings of the metering device. In the process, the protective cap position required for activation of the vibration mechanism or the conveying mechanism is achieved and, in the course of the process, the corresponding function is initiated. Such a coupling of the primary protective cap function as protection of the metering device and of the secondary function as actuating means ensures that an activation of the vibration mechanism or of the conveying mechanism takes place only in the open state. Misoperation, for example activation of the vibration mechanism when the metering openings are closed, is prevented as a result. Furthermore, such a design may also be expedient economically, since one and the same handle can be used as the protective cap and actuating handle. The operative connection between the protective cap position and the activation of the vibration mechanism and/or of the conveying mechanism can be achieved, for example, by means of cams on the protective cap, the cams interacting with microswitches which, for their part, are in turn connected to a controller.

In a development of the invention, the means are designed for identifying at least two protective cap positions and are operatively connected to the vibration mechanism and the conveying mechanism in such a manner that, in a first protective cap position, the conveying mechanism is activated and, in a second protective cap position, the vibration mechanism is activated.

By this means, it is possible to couple the steps, to be carried out successively, of filling the metering chamber by means of the conveying mechanism and of discharging the medium by means of the vibration mechanism to the movement of the protective cap. In this connection, it is particularly appropriate to activate the conveying mechanism directly after the protective cap opens up the metering openings, and, as soon as the protective cap has reached its end position, to activate the vibration mechanism. As an alternative to this, it is also possible to activate the conveying mechanism for a subsequent discharging operation even as the protective cap is being closed and to activate the vibration mechanism during opening of the protective cap.

The invention relates furthermore to a metering device of the type in question, in which a surface which can be adjusted with regard to its wettability by application of a voltage is provided on an inner surface of the wall sections which delimit the metering chamber and/or on an outer surface of the outlet wall section.

Adjustability makes it possible to design the corresponding surface to be sometimes hydrophilic, i.e. water-loving, and sometimes hydrophobic, i.e. water-repelling. This adjustability makes it always possible to provide the ideal state of wettability, in particular within the metering chamber. During the filling of the metering chamber before the discharging operation, it is advantageous if the surface is hydrophilic, since this avoids air remaining in the metering chamber. Instead, the air, which, on account of the hydrophilic surface, is displaced from the surface by the medium flowing in, is forced out through the metering openings until the metering chamber is completely filled with medium. By contrast, during the discharging operation, a hydrophilic surface within the metering chamber is not desirable, since it stands in the way of complete discharging of the medium. The surface is therefore set during the discharge into a hydrophobic state which assists with the discharging operation, since the medium does not remain stuck to the inner surface of the metering chamber, and therefore only small forces are required in order to dispense the medium from the metering chamber through the metering openings into the environment.

The adjustability of the wettability is particularly advantageously achieved in that the surface has an outer layer, which is of hydrophobic design, and has an inner layer which is designed as an electrode, with an insulator layer preferably being formed between the inner layer and the outer layer.

Such a build up of layers of the surface permits an effect which is known as "electrowetting". The surface which is hydrophobic per se becomes hydrophilic by application of a voltage to the electrode. Such a surface can be produced in a simple and favorable manner. The insulator layer which is preferably to be provided between the hydrophobic outer layer and the inner electrode layer makes it possible to dispense with the necessity of designing the hydrophobic layer itself as a non-conductive layer.

BRIEF DESCRIPTION OF THE DRAWINGS

Further advantages and features of the invention emerge from the claims and from the description below of preferred exemplary embodiments of the invention, which are illustrated with reference to the drawings, in which:

DETAILED DESCRIPTION

Figure 1:
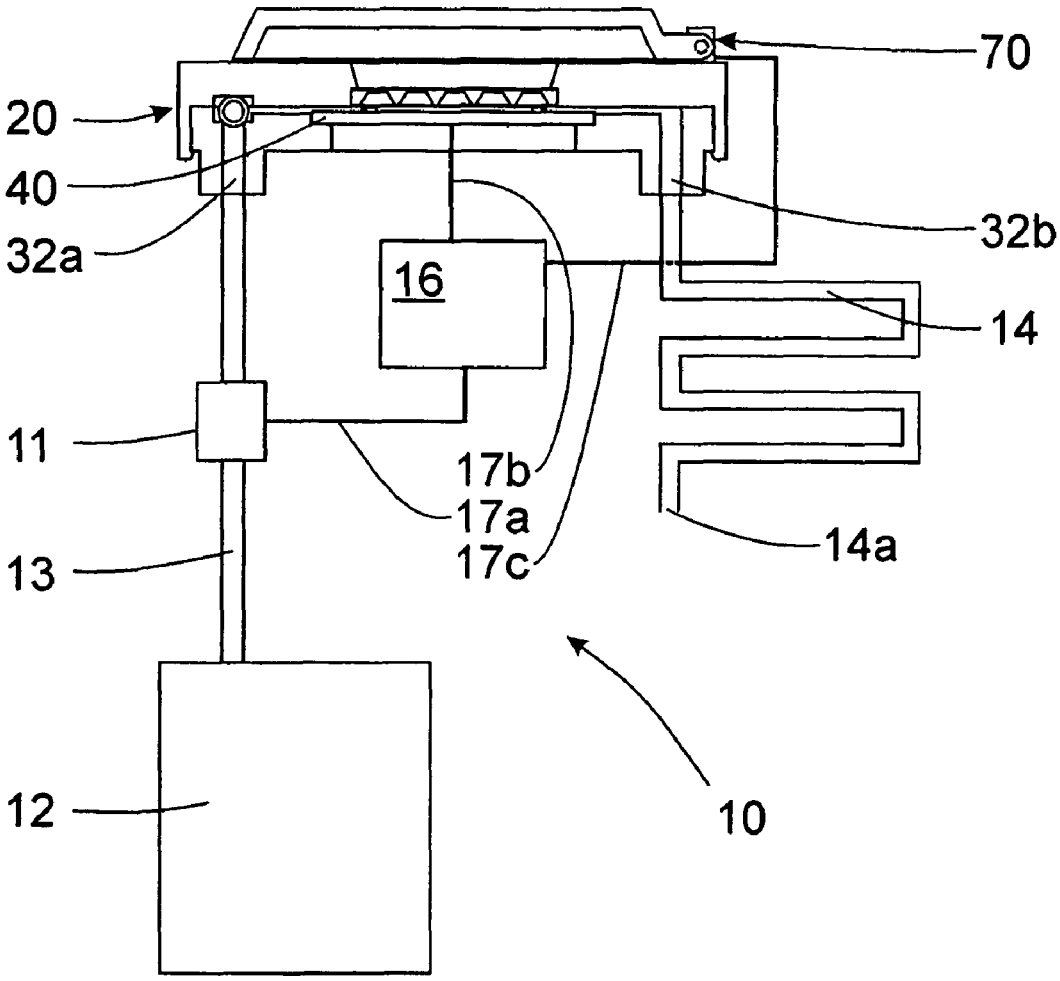
FIG. 1 shows a first embodiment of a metering device according to the invention as part of a schematically illustrated discharging device.

FIG. 1 shows a metering device 20 according to the invention which is part of a discharging device 10 (only illustrated schematically). In addition to the metering device 20, the discharging device 10 has a media reservoir 12 which is connected to a first media inlet 32*a* of the metering device 20 via a supply passage 13. A conveying mechanism 11, which is an electrically operated pump in the present case, is provided in the supply passage 13. A stock reservoir 14 which is designed as a meandering passage and the end 14*a* of which is open is connected to a second media inlet 32*b* of the metering device 20. The discharging device 10 furthermore has a controller 16 which is provided for controlling the conveying of media into the metering device and for controlling the discharging operation. The controller 16 is connected to the conveying mechanism 11 via a first signal line 17*a*. Furthermore, the controller 16 is connected to a vibration mechanism 40 of the metering device 20 via a second signal line 17*b*. A third signal line 17*c* connects the controller 16 to an actuating means 70 of the metering device 20.

Via the first and the second signal lines 17*a*, 17*b*, the controller 16 controls the conveying mechanism 11, the task of which is the filling of the metering device 20 with medium, and the vibration mechanism 40, the task of which is the discharging of media from the metering device 20. This takes place as a function of an activation initiated by a user by means of the actuating means 70 and is explained in more detail below.

Figure 2:
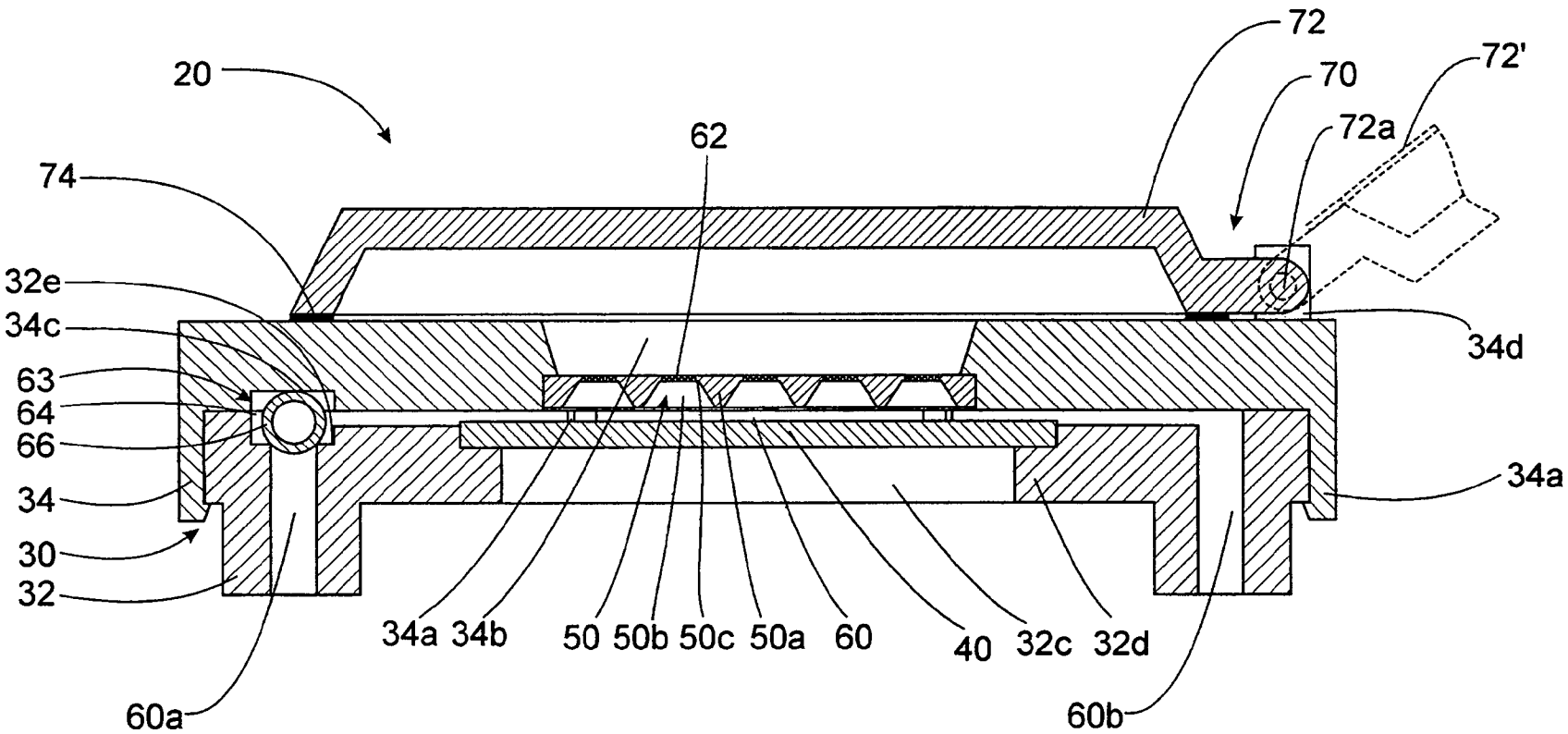
FIG. 2 shows the metering device illustrated in FIG. 1 in an enlarged view as a sectional illustration.

FIG. 2 shows the metering device 20 of FIG. 1 in a detailed view. The metering device 20 has a housing 30 which comprises a housing lower part 32 and a housing upper part 34. The housing upper part 34 is connected to the housing lower part 32 via latching means 34*a* in the form of latching lugs.

An aperture 32*c*, into which the vibration mechanism 40 in the form of a vibration wall section 40 is inserted, is provided in the housing lower part 32. The aperture 32*c* has a diameter which approximately corresponds to that of the vibration wall section 40. In addition, bearing webs 32*d* on which the vibration wall section 40 rests are provided in the lower housing part 32, and therefore the vibration wall section 40 can only be removed from above from the housing lower part 32. Securing webs 34*a* are integrally formed on the housing upper part 34, the securing webs 34*a* extending in the direction of the vibration wall section 40 and pressing the latter against the bearing webs 32*d* such that it is completely fixed in the position illustrated.

Furthermore, an outlet wall section 50 is inserted in the housing upper part 34 in a manner lying opposite the vibration wall section 40 and is held by the upper housing part 34 in a manner not illustrated specifically, for example with a cohesive material joint or frictionally, in an aperture 34*b* provided for it. The intermediate space between the outlet wall section 50 and the vibration wall section 40 forms a metering chamber 60. The outlet wall section 50 is designed as a silicon plate which has integrally formed stabilizing webs 50*a* which extend parallel to the planar extent of the silicon plate on the metering chamber side. Recesses 50*b* which widen in the direction of the metering chambers 60 are arranged between said stabilizing webs 50*a*. Respective metering openings 62, which are designed as thin apertures in the outlet wall section 50, are provided in the base 50*c* of the recesses 50*b*. Medium located in the metering chamber 60 can be discharged through the metering openings 62 into the environment. The metering chamber 60 is connected firstly to the media reservoir 12 and secondly to the stock reservoir 14 via two medium inlets or passages 60*a*, 60*b*. The first media passage 60*a* differs from the second media passage 60*b* in that a nonreturn valve 63 is provided in its course, the nonreturn valve 63 being composed of a valve chamber 64 and a shut off body 66 arranged in the metering chamber 60. The valve chamber 64 here is formed by recesses 32*e*, 34*c* which are provided in the housing lower part 32 and in the housing upper part 34. The shut off body 66 is designed as a hollow-spherical and elastic body.

On an outer side of the housing upper part 34, a combined protective and actuating means 70 is provided in the region of the aperture 34*b*. The protective and actuating means 70 comprises a protective cap 72 which, in a closed state illustrated in FIG. 2, covers the metering openings 62 in relation to the environment. For this purpose, an encircling sealing section 74 is fastened to the protective cap 72, the sealing section 74, in the closed state, bearing against the housing upper part 34 and effectively preventing any emergence of medium from the metering device 20 and any entry of contaminants from the outside. The protective cap 72 is mounted by means of two journals 72*a* in bearings 34*d* which are integrally formed on the housing upper part 34. The protective cap 72 can be pivoted about the bearings 34*d* in such a manner that they take up the end position 72' illustrated by dashed lines. In such a pivoted state, the metering openings 62 are open and permit the medium to be discharged.

The manner of operation of the discharging device 10 and, in particular, of the metering device 20, which are illustrated in FIGS. 1 and 2, is explained below.

Before a discharging operation, the metering chamber 60, the stock reservoir 14 and the passage section situated in between are filled with medium from the media reservoir 12 by means of the conveying mechanism 11. If the quantity of medium which has been pumped into the metering device 20 via the first media inlet 32*a* is greater than the volume to be filled by metering chamber 60 and stock reservoir 14, excess medium is dispensed to the environment at the end 14*a* of the stock reservoir 14. After the end of the conveying operation, there is therefore a defined quantity of media in the metering chamber 60, the stock reservoir 14 and the passage sections on the other side of the nonreturn valve 63. Part of the air located there before the conveying operation is forced out of the end 14*a* of the stock reservoir 14 and part is ejected from the metering chamber 60 through the metering opening 62. In this case, the stabilizing webs 50*a* ensure that the air cannot escape into a region of the metering chamber 60, from which exit to the outside is not possible, but, instead, is reliably conducted to the metering openings 62.

After the conveying operation is finished, the vibration mechanism 40 is activated. Its vibrations cyclically increase and reduce the volume in the metering chamber 60 at high frequency, with the medium located in the metering chamber 60 being pushed through the metering openings 62 and being supplied there in the form of fine mist for its use. During the discharging operation, the metering chamber 60 is fed with further medium from the stock reservoir 14. By contrast, no medium can penetrate the system through the first medium inlet 32*a* during the discharging operation, since the nonreturn valve 63 prevents further medium being let in. As a result, the quantity of media which can be discharged is limited to a desired amount and is composed of the medium which is present in the metering chamber 60 and the stock reservoir 14 after the filling operation.

The conveying mechanism 11 and the vibrating mechanism 40 are controlled by the controller 16 which is illustrated in FIG. 1 and which, in turn, is connected to a sensor (not illustrated) within the mounting 34*d*. The sensor perceives the pivoted position of the protective cap 72 and triggers the various functions as a function of the pivoted position. The programming of the controller 16 may be designed for different conditions. For example, a programming is conceivable in which even a slight raising of the protective cap 72 leads to the conveying mechanism 11 being triggered and therefore to the metering chamber 60 and the stock reservoir 14 being filled. The triggering of the discharging operation by activation of the vibration mechanism 40 can follow when the end pivoted position 72' is reached. In an alternative programming of the controller 16, the filling of the metering chamber 60 and of the stock reservoir 14 takes place during the closing of the protective cap 72, and therefore the metering chamber 60 and the stock reservoir 14 are immediately filled again after use of the discharging device 10.

Figure 3:
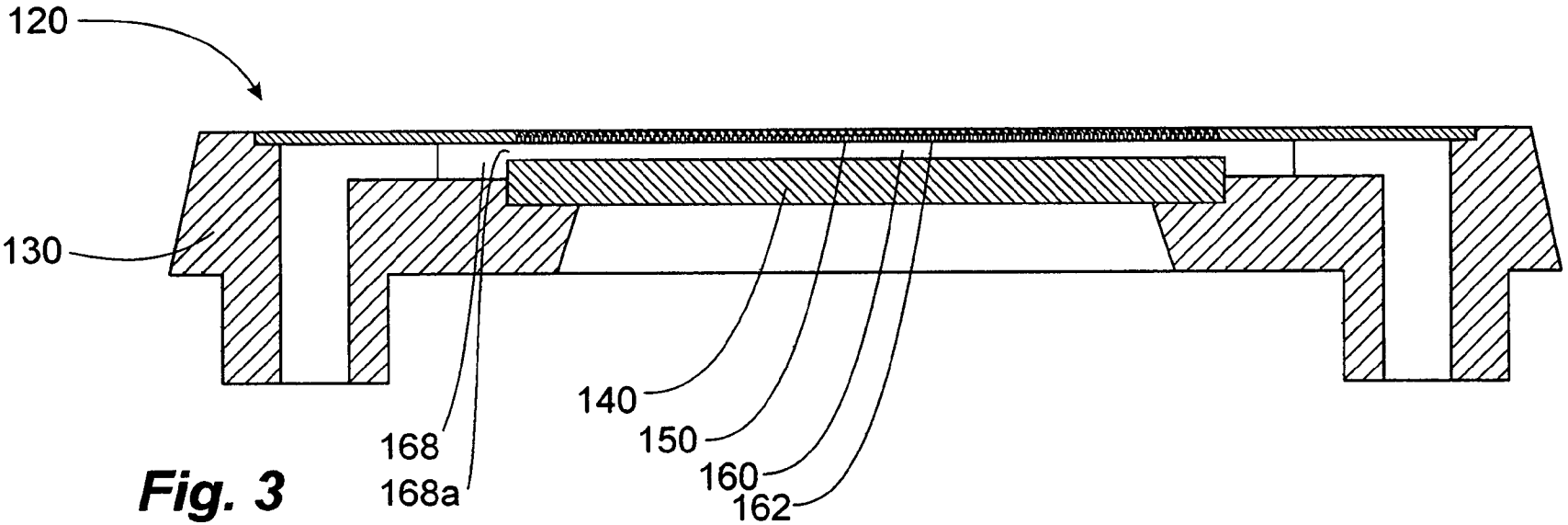
FIG. 3 shows a second embodiment of a metering device according to the invention as a sectional illustration.

FIG. 3 shows a second embodiment of a metering device 10 according to the invention. The metering device 120 has a housing 130 which is designed as a single piece. In a similar manner as in the metering device 20 of the first embodiment, in the metering device 120 a vibration wall section 140 is fitted in a recess 130*c* of the housing 130. The housing 130 is closed off at the top by an outlet wall section 150 in which metering openings 162 are provided. The metering openings 162 are located in a region above the vibration wall section 140. Between the vibration wall section 140 and the outlet wall section 150 there is a metering chamber 160 which is surrounded by an encircling annular passage 168. Between the metering chamber 160 and the annular passage 168, an inlet of media through an inlet gap 168*a* is possible over the entire extent of the vibration wall section 140.

Figure 3A:
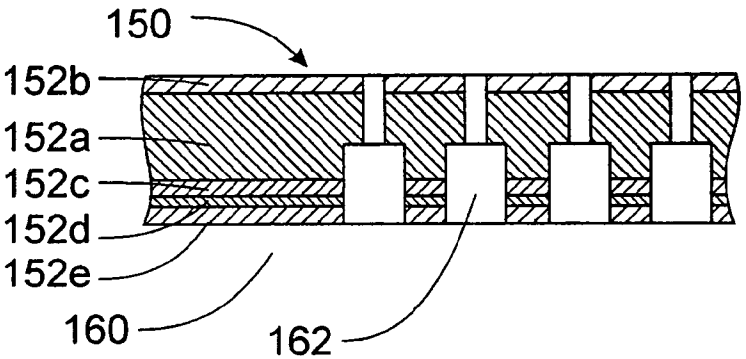
FIG. 3*a* shows a detail from an outlet wall section of the metering device illustrated in FIG. 3.

FIG. 3*a* shows, in an enlarged view, a detail from the outlet wall section 150 in which the metering openings 162 are provided. The structure of the outlet wall section 150 has a support layer 152*a* which gives the outlet wall section 150 its stability. It may be, for example, a layer of metal or silicon. On the outer side, a heating resistance layer 152*b* which can be heated by application of a voltage is provided on the substrate 152*a*. On the inner side of the structure of the outlet wall section 150, an electrode layer 152*c*, an insulator layer 152*d*, which is preferably designed as a dielectric layer, and a hydrophobic layer 152*e* are provided on the substrate 152*a*.

This layered structure of the outlet wall section 150 has two functions. The heating resistance layer 152*b* permits the outer surface of the outlet wall section 150 to be heated, thereby preventing the formation of a liquid film on the surface and the associated obstruction of the dispensing of media. As soon as medium which exits through the metering openings 162 remains stuck on the outer surface, an evaporation takes place within a short time, and therefore medium which follows exits again without obstruction in the correct manner in the form of mist. The layers 152*c*, 152*d*, 152*e* on the inner side of the outlet wall section 150 permit an optional switching over of the inner surface between hydrophobic and hydrophilic. If a voltage is not applied, the inner side of the surface of the outlet wall section 150 is hydrophobic because of the hydrophobic layer 152*e*. This is achieved, for example, by a silanized surface in the form of the hydrophobic layer 152*e*. However, a hydrophilic behavior of the inner surface may also be obtained, as the case may be, by application of a voltage at the electrode layer 152*c*.

This possibility of switching over the wettability of the inner surface is expedient with respect to the different stages of filling the metering chamber 160 and the discharge and also the various requirements. While the metering chamber 160 is being filled with medium, the surface is set to hydrophilic such that air can easily be displaced out of the metering chamber 160. As soon as the discharging operation begins, a strong adhesion between the liquid and the outlet wall section 150 is no longer desirable, since the adhesion increases the expenditure of energy required in order to discharge the medium. The surface is therefore set to hydrophobic during the discharging operation.

Figure 3B:
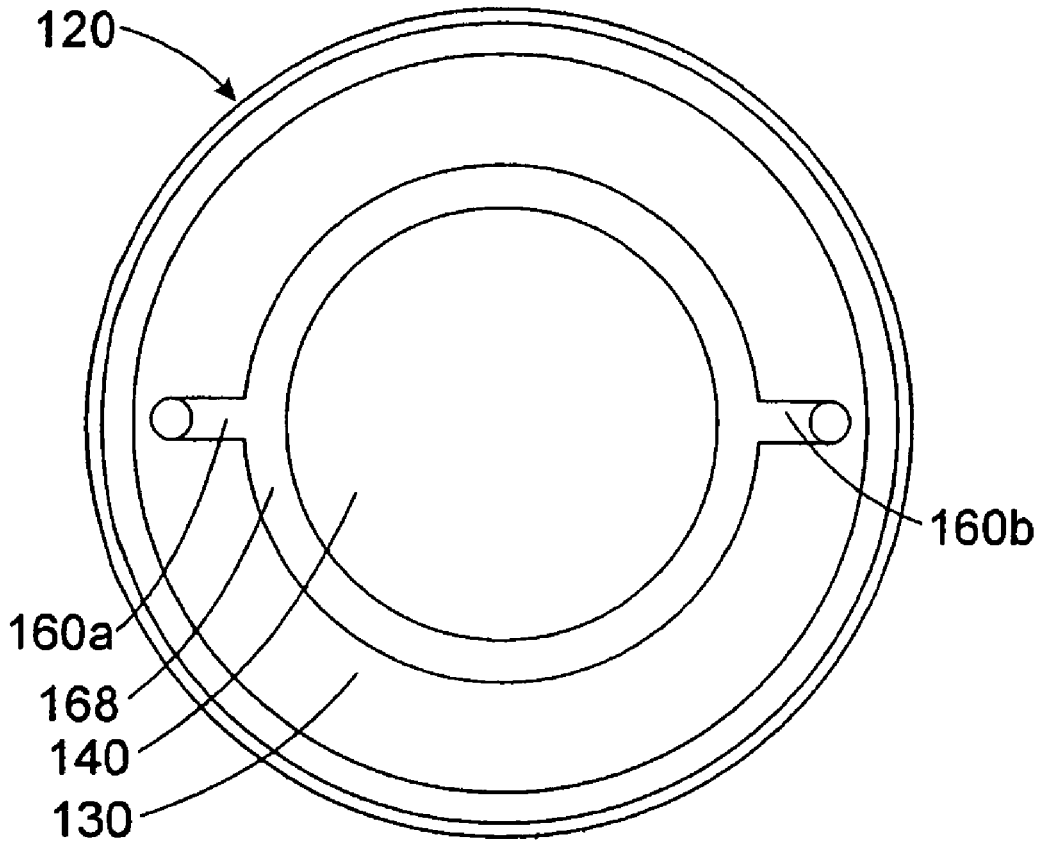
FIG. 3*b* shows a plan view of the metering device illustrated in FIG. 3 with the outlet wall section removed.

FIG. 3*b* shows the housing 130 and the vibration wall section 140 from above, with the outlet wall section 150 being removed for better understanding. It can be see that media inlets 160*a* and 160*b* for the supply of medium from the media reservoir and possibly present stock reservoir lead into the annular passage 168 which completely surrounds the metering chamber 160 and the vibration wall section 140. During operation, the annular passage 168 provides a media reservoir which, during the continuous discharging of the medium, supplies the metering chamber 160 continuously and on all sides with medium. Furthermore, the effect achieved by the inflow which is possible on all sides is that a substantially uniform discharge through all of the metering openings 162 takes place.

The invention claimed is:

1. Metering device for dispensing a medium to an environment, comprising:

a housing;

a shallow metering chamber within the housing, the metering chamber being of planar design and being essentially closed off from the environment by wall sections;

a first media inlet which is connected to the metering chamber and can be connected to a media reservoir;

a vibration mechanism arranged in such a manner that vibrations generated by the vibration mechanism cause pulsing changes in volume of an internal volume of the metering chamber, the vibration mechanism forming a vibration wall section which delimits the metering chamber;

a wall section designed as an outlet wall section, the wall section having metering openings connecting the metering chamber to the environment; and a protective cap provided on a side of the metering openings that faces away from the metering chamber, the protective cap, in a closed state, closing off the metering openings from the environment and, in an open state, opening up the metering openings in relation to the environment, the protective cap being designed as an actuating means for operating the metering device.

2. Metering device according to claim 1, wherein the vibration wall section closes off the metering chamber on a side which is opposite the outlet wall section.

3. Metering device according to claim 1, wherein the housing has an aperture for receiving the vibration wall section and, on a border of the aperture, has an encircling bearing web which extends radially into the aperture.

4. Metering device according to claim 1, wherein the housing is a multi-part design, and has an upper part and a lower part, and a receiving space for receiving the vibration wall section is provided in the lower part, the receiving space being delimited by fastening sections.

5. Metering device according to claim 1, wherein the protective cap has an elastic sealing means, which, in the closed state of the protective cap, closes off the metering openings from the environment.

6. Metering device according to claim 1, wherein the protective cap is fastened to the housing and is movable between the closed state and the open state, the protective cap having identification means for identifying at least one protective cap position being provided, the identification means being operatively connected to the vibration mechanism and/or a conveying mechanism for conveying the medium in such a manner that a movement of the protective cap into the protective cap position activates or deactivates the vibration mechanism and/or the conveying mechanism.

7. Metering device according to claim 6, wherein the identification means are designed for identifying at least two protective cap positions and are operatively connected to the vibration mechanism and the conveying mechanism in such a manner that, in a first protective cap position, the conveying mechanism is activated and, in a second protective cap position, the vibration mechanism is activated.

* * * * *